US006760942B2

(12) United States Patent
Lee et al.

(10) Patent No.: US 6,760,942 B2
(45) Date of Patent: Jul. 13, 2004

(54) WASHING PATTERN DETERMINATION METHOD

(75) Inventors: Chul Woong Lee, Seoul (KR); Jae Cheon Lee, Seoul (KR); Min Kyu Hwang, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/853,613

(22) Filed: May 14, 2001

(65) Prior Publication Data

US 2002/0040259 A1 Apr. 4, 2002

(30) Foreign Application Priority Data

Oct. 2, 2000 (KR) ..... 2000-57957

(51) Int. Cl.[7] ..... D06F 33/02
(52) U.S. Cl. ..... 8/159; 68/12.16; 68/12.04
(58) Field of Search ..... 700/170; 68/12.02, 68/12.04, 12.16; 8/159

(56) References Cited

U.S. PATENT DOCUMENTS

| | | | | | |
|---|---|---|---|---|---|
| 4,556,827 | A | * | 12/1985 | Erdman | 318/254 |
| 4,595,865 | A | * | 6/1986 | Jahns | 318/254 |
| 4,862,710 | A | * | 9/1989 | Torita et al. | 68/12 |
| 4,959,596 | A | * | 9/1990 | MacMinn et al. | 318/254 |
| 5,161,393 | A | * | 11/1992 | Payne et al. | 68/12.04 |
| 5,233,847 | A | * | 8/1993 | Tanaka | 68/12.04 |
| 5,293,760 | A | * | 3/1994 | Tani et al. | 68/12.02 |
| 5,477,471 | A | * | 12/1995 | Baum et al. | 364/571.01 |
| 5,604,387 | A | * | 2/1997 | Cheyne | 307/125 |
| 5,671,493 | A | * | 9/1997 | Moon | 8/159 |
| 6,442,979 | B1 | * | 9/2002 | Thorn et al. | 68/12.16 |
| 6,445,879 | B1 | * | 9/2002 | Youn et al. | 388/811 |
| 6,550,290 | B2 | * | 4/2003 | Shimakage et al. | 68/12.04 |

OTHER PUBLICATIONS

Gyung–Hae Han; Hwa–Young Yi; Bum–Suk Go; Dong–Geun Lee; In–Haeng Cho; Dong–Il Oh, A New ASCI for Washer Controller, Circuits and Systems, 1999. ISCAS '99. Proceedings of the 1999 IEEE International Symposium, vol.: 6, Jul. 1999, pp.: 485–488.*

* cited by examiner

*Primary Examiner*—Leo Picard
*Assistant Examiner*—Sean Shechtman
(74) *Attorney, Agent, or Firm*—Birch, Stewart, Kolasch & Birch, LLP

(57) ABSTRACT

An apparatus and method for determining a washing pattern of a direct drive inverter-type washing machine. The apparatus comprises a voltage converter for inputting an external alternating current (AC) voltage and rectifying and smoothing the inputted AC voltage to convert it into a drive voltage necessary to a washing mode of a washing machine, a switch for performing a switching operation in response to a motor drive control signal to transfer the drive voltage from the voltage converter to a motor so as to rotate or stop a washing tub, a voltage variation sensing device for measuring a voltage variation when the motor rotates in response to the drive voltage transferred from the switch and outputting the measured result as a voltage variation sense signal, and a microcomputer for driving the motor in a laundry amount sensing pattern at the time that laundry is put into the washing tub, judging the amount of the laundry and the amount of water supply depending on the laundry amount, judging the type of a material of the laundry in response to the voltage variation sense signal at the time that wash water is supplied to the tub, producing an optimum washing pattern appropriate to the amount and material type of the laundry within the washing tub and generating the motor drive control signal to drive the motor in the produced optimum washing pattern.

4 Claims, 7 Drawing Sheets

WASHING PATTERN DETERMINATION METHOD

BACKGROUND OF THE INVENTION

1. Field of the Invention

The present invention relates in general to an apparatus and method for determining a washing pattern according to the type of a material of laundry, and more particularly to a washing pattern determination apparatus and method wherein a microcomputer judges the type of a material of laundry put into a washing tube of a direct drive-type washing machine on the basis of a voltage variation measured through resistors in a voltage variation sensing device when a motor is driven, as well as the amount of the laundry, and then varies a washing pattern appropriately to the judged laundry material type.

2. Description of the Prior Art

Generally, if laundry such as dirty clothing is put into washing liquid within a washing tub of a washing machine, then it is removed of dirt owing to a chemical action of a detergent. But, because a large amount of time is required in washing off the dirt from the laundry with only the chemical action of the detergent, a mechanical action such as friction or vibration is additionally applied to the laundry to increase the washing speed of the laundry.

A conventional method for controlling a washing mode of such a washing machine comprises sensing and judging the amount of laundry, such as clothing, put into a washing tub, setting the flow of water, the type of a detergent and the total washing time according to the judged laundry amount, agitating the water by normal and reverse rotations of an agitator for the set washing time and separating dirt from the laundry by its friction with the water.

In the above-mentioned washing mode control method, in order to maintain the level and flow pattern of water appropriate to the amount of laundry in the washing tub at the initial step of the washing mode, a water supply valve is opened to a degree depending on the laundry amount and then supplies water up to a set level. Typically, a laundry amount sensing device is adapted to sense the amount of laundry in the washing tub.

FIG. 1 shows the construction of a conventional laundry amount sensing device for a washing machine. As shown in this drawing, the conventional laundry amount sensing device comprises a voltage converter 10 for inputting an external alternating current (AC) voltage and rectifying and smoothing the inputted AC voltage to convert it into a direct current (DC) voltage, a switch 11 for performing a switching operation to transfer motor drive signal current, a motor 12 rotating in response to the motor drive signal current from the switch 11 to perform a driving operation, and a microcomputer 13 for generating the motor drive signal current, sensing the driving operation of the motor 12 and controlling a washing pattern based on the amount of laundry in accordance with the sensed result.

A hall sensor 14 is attached to the motor 12 to sense the number of revolutions and rotation velocity of the motor 12.

FIG. 2*a* is a graph showing a waveform of an output signal from the hall sensor 14 when laundry is light, and FIG. 2*b* is a graph showing a waveform of an output signal from the hall sensor 14 when laundry is heavy.

A description will be given of the operation of the conventional laundry amount sensing device with the above-mentioned construction with reference to the drawings. If a washing mode of the washing machine is started, the microcomputer 13 drives the motor 12 in a laundry amount sensing pattern to rotate a washing tub under the condition that no wash water is supplied to the washing tub. Thereafter, if the microcomputer 13 turns off the drive signal to the motor 12 as indicated by D and F in FIGS. 2*a* and 2*b*, then the motor 12 makes surplus rotations owing to inertia.

While the motor 12 makes surplus rotations in this manner, the hall sensor 14 attached to the motor 12 generates signals having different surplus rotational periods and times according to different amounts of laundry, by E and G in FIGS. 2*a* and 2*b*.

The microcomputer 13 processes such output signals from the hall sensor 14 as interrupt signals, judges the amount of laundry from a difference between their numbers, sets a washing pattern, such as a washing speed or time, on the basis of the judged laundry amount and performs the washing mode according to the set washing pattern.

FIG. 3 is a graph showing the number of surplus revolutions of the motor 12 depending on the amounts of laundry. It can be seen from this drawing that the number of the surplus revolutions of the motor 12 increases as laundry becomes heavier.

However, the above-mentioned conventional washing machine has a disadvantage in that the washing pattern is set on the basis of only the sensed laundry amount irrespective of the kind of the laundry put into the washing tub. In other words, if the laundry is thin and light, it may be damaged due to over-washing. On the contrary, in the case where the laundry is thick, it may be poorly washed.

SUMMARY OF THE INVENTION

Therefore, the present invention has been made in view of the above problems, and it is an object of the present invention to provide washing pattern determination apparatus and method wherein a microcomputer judges the type of a material of laundry put into a washing tub of a washing machine on the basis of a voltage variation resulting from its friction with water when a motor is driven, as well as the amount of the laundry, and then varies a washing pattern appropriately to the judged laundry material type.

In accordance with one aspect of the present invention, the above and other objects can be accomplished by the provision of a washing pattern determination apparatus comprising a voltage converter for inputting an external alternating current (AC) voltage and rectifying and smoothing the inputted AC voltage to convert it into a drive voltage necessary to a washing mode of a washing machine; a switch for performing a switching operation in response to a motor drive control signal to transfer the drive voltage from the voltage converter to a motor so as to rotate or stop a washing tub; voltage variation sensing means for measuring a voltage variation when the motor rotates in response to the drive voltage transferred from the switch and outputting the measured result as a voltage variation sense signal; and a microcomputer for driving the motor in a laundry amount sensing pattern at the time that laundry is put into the washing tub, judging the amount of the laundry and the amount of water supply depending on the laundry amount, judging the type of a material of the laundry in response to the voltage variation sense signal from the voltage variation sensing means at the time that wash water is supplied to the washing tub, producing an optimum washing pattern appropriate to the amount and material type of the laundry within the washing tub and generating the motor drive control signal to drive the motor in the produced optimum washing pattern.

Preferably, the voltage variation sensing means may include a pair of sensing resistors connected to a direct current (DC) link terminal connected to a switch performing a switching operation to drive the motor.

In accordance with another aspect of the present invention, there is provided a washing pattern determination method comprising the steps of a) driving a motor in a laundry amount sensing pattern if laundry is put into a washing tub and judging the amount of the laundry and the amount of water supply depending on the laundry amount; b}supplying wash water to the washing tub if the step a) is completed, driving the motor in a laundry material sensing pattern, measuring a voltage variation applied across a DC link terminal connected to a switch performing a switching operation to drive the motor and generating a voltage variation sense signal in accordance with the measured result; c) judging the type of a material of the laundry in response to the voltage variation sense signal generated at the step b) and producing a washing pattern appropriate to the amount and material type of the laundry within the washing tub; and d) generating a motor drive control signal to drive the motor in the washing pattern produced at the step c), thereby performing an optimum washing mode.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 4:
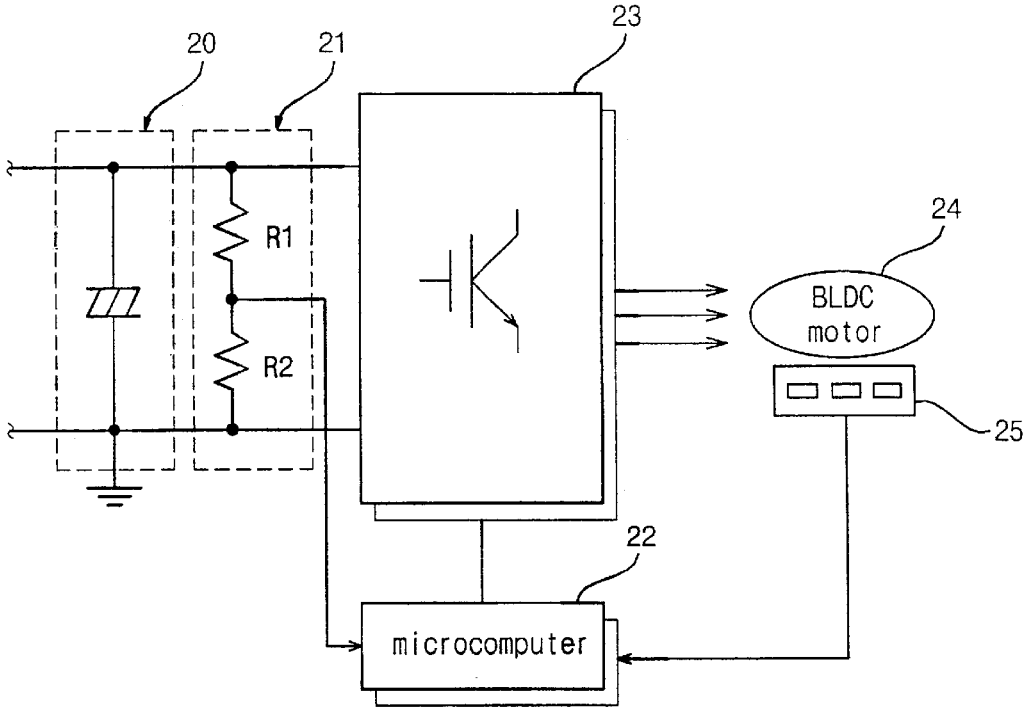
FIG. 4 is a view showing the construction of a washing pattern determination apparatus in accordance with the present invention.

With reference to FIG. 4, there is shown the construction of a washing pattern determination apparatus in accordance with the present invention. As shown in this drawing, the washing pattern determination apparatus comprises a voltage converter 20 for inputting an external AC voltage and rectifying and smoothing the inputted AC voltage to convert it into a drive voltage necessary to a washing mode of a washing machine, a microcomputer 22 for judging the amount and material type of laundry at the initial step of the washing mode and controlling a system operation in accordance with the judged results to produce an optimum washing pattern algorithm, a switch 23 for performing a switching operation according to the washing pattern algorithm produced by the microcomputer 22 to transfer motor drive current from the voltage converter 20, a motor 24 for starting or stopping rotations in each pattern set by the microcomputer 22 in response to the motor drive current transferred from the switch 23, and a voltage variation sensing device 21 for measuring a voltage variation when the motor 24 rotates in a laundry material sensing pattern, and transferring the measured result to the microcomputer 22.

Figure 1:
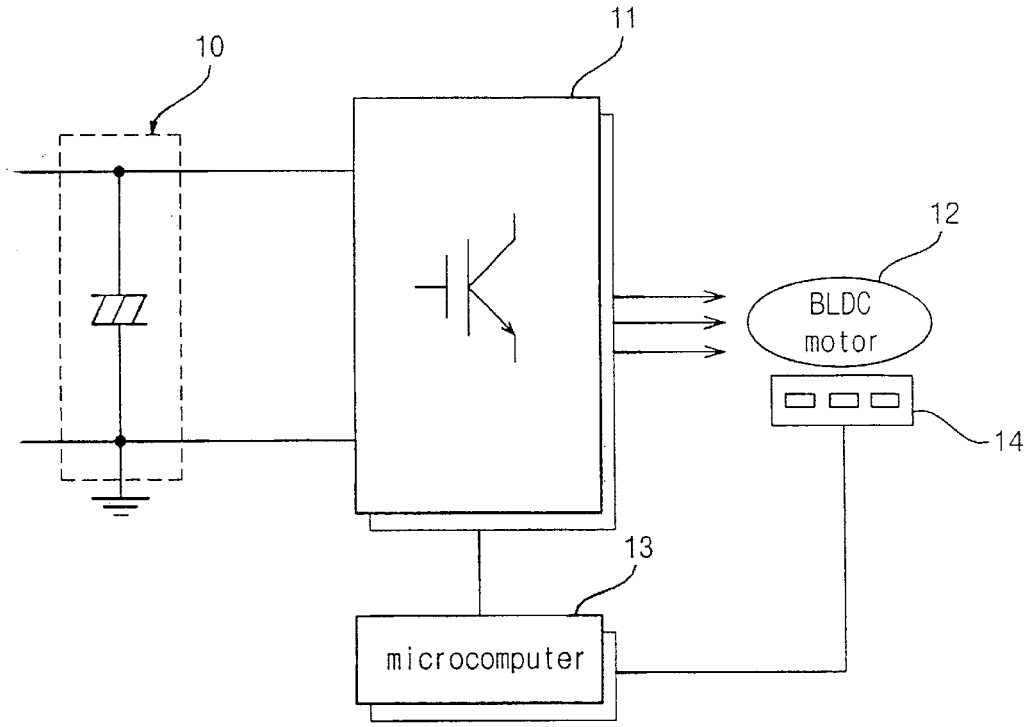
FIG.1(Prior Art)
FIG. 1 is a view showing the construction of a conventional laundry amount sensing device for a washing machine.
Figure 2A:
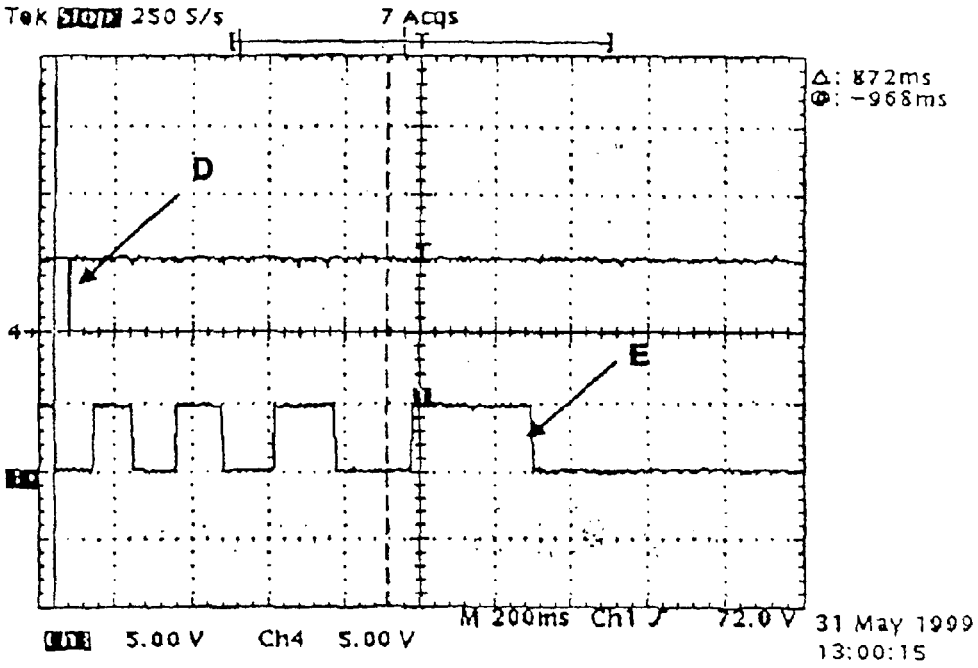
FIG.2a(Prior Art)
FIG. 2*a* is a graph showing a waveform of an output signal from a hall sensor when laundry is light.
Figure 2B:
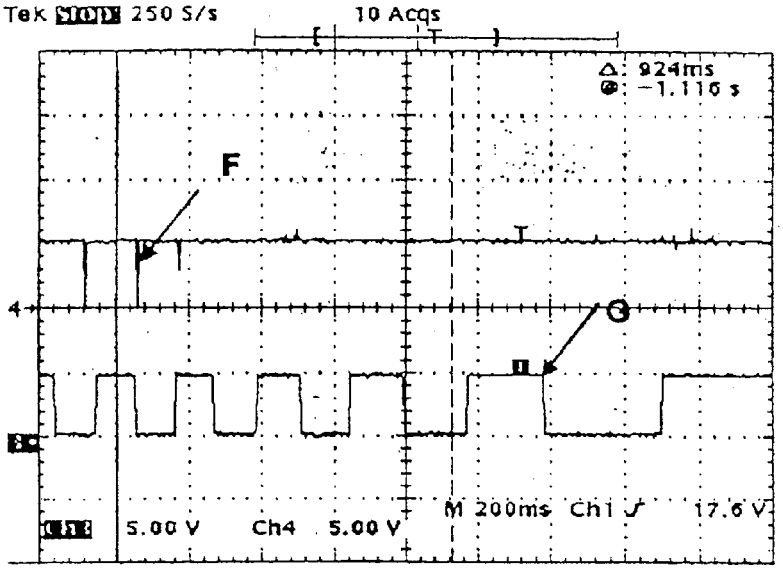
FIG.2b(Prior Art)
FIG. 2*b* is a graph showing a waveform of an output signal from the hall sensor when laundry is heavy.
Figure 3:
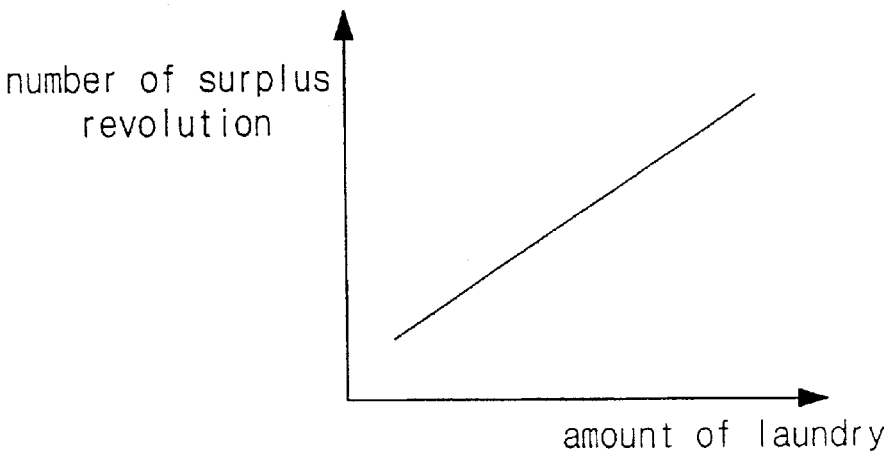
FIG.3(Prior Art)
FIG. 3 is a graph showing the number of surplus revolutions of a motor depending on the amounts of laundry.

At the time that laundry is put into a washing tub, the microcomputer 22 drives the motor 24 in a laundry amount sensing pattern under the condition that no wash water is supplied to the washing tub. If the microcomputer 22 turn off the motor 24 after turning it on for a predetermined period of time, then the motor 24 makes surplus rotations owing to inertia. While the motor 24 makes surplus rotations, a hall sensor 25 attached to the motor 24 generates signals having different surplus rotational periods and times according to different amounts of laundry, as indicated by E and G in FIGS. 2*a* and 2*b*. Then, the microcomputer 22 processes such output signals from the hail sensor 25 as interrupt signals and judges the amount of laundry from a difference between their numbers.

After judging the laundry amount, the microcomputer 22 supplies wash water of an amount corresponding thereto and then turns on/off the switch 23 to drive the motor 24 in the laundry material sensing pattern. At this time, the material type of the laundry is sensed by the voltage variation sensing device 21, which is connected to a DC link terminal of the motor 24.

Then, in order to advance the washing mode in an optimum state while preventing the laundry in the washing tub from being damaged, the microcomputer 22 produces an optimum washing pattern algorithm appropriate to the amount and material type of the laundry and controls the system operation according to the produced algorithm.

On the other hand, the voltage variation sensing device 21 includes a pair of sensing resistors R1 and R2 connected in series to the DC link terminal of the motor 24, and a sensing point positioned between the resistors R1 and R2 for monitoring a voltage variation.

Figure 5:
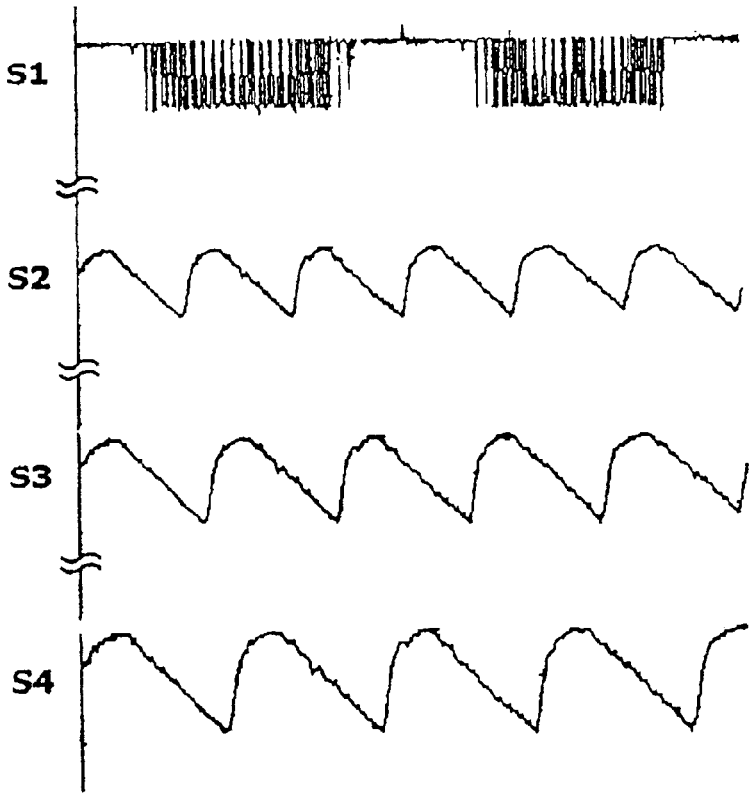
FIG. 5 is a graph showing voltage variations depending on materials of laundry in accordance with the present invention.

FIG. 5 is a graph showing voltage variations depending on materials of laundry in accordance with the present invention, wherein S21 shows a waveform based on ON/OFF time intervals for the rotation of the motor, and S22 to S24 show waveforms of voltage variations at the DC link terminal when the motor rotates.

In more detail, S22, S23 and S24 show waveforms of output signals from the voltage variation sensing device 21 when the laundry material is thin, when it is normal and when it is thick, respectively.

For laundry of a thick and stiff material, a high voltage variation occurs in the DC link terminal, or the voltage variation sensing device 21, because its friction with water becomes large and a drive force being required increases accordingly, resulting in the flow of a large amount of current.

On the contrary, for laundry of a thin material, a voltage variation S22 sensed by the voltage variation sensing device 21 is relatively lower than a voltage variation S23 for laundry of a normal material.

Figure 6:
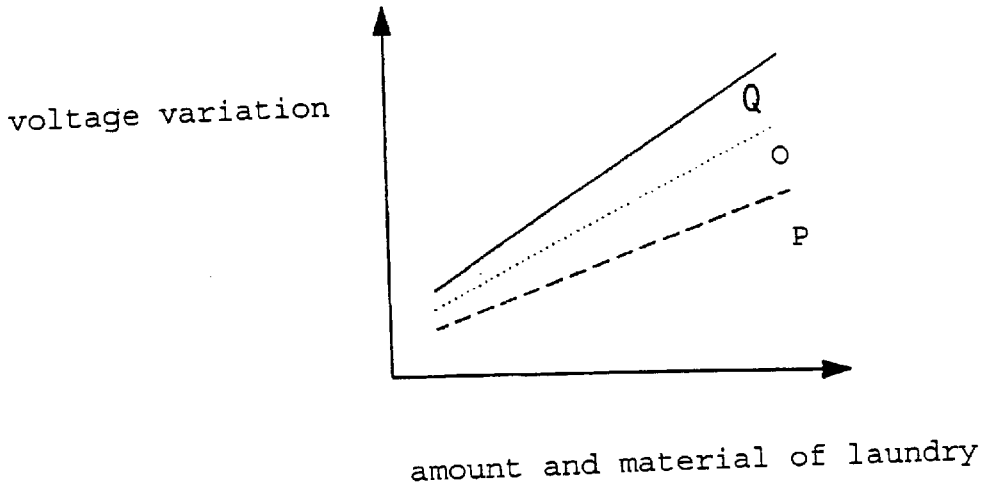
FIG. 6 is a graph showing voltage variations depending on the amounts and materials of laundry.

FIG. 6 is a graph showing voltage variations depending on the amounts and materials of laundry, wherein the X axis represents the amounts of laundry and the Y axis represents voltage variations. Also, O represents laundry of a normal material, P represents laundry of a thin material and Q represents laundry of a thick material.

From this drawing, it can be seen that the voltage variation increases as the laundry amount becomes larger and, in the same laundry amount condition, the voltage variation increases as the laundry material becomes thicker. In this regard, the microcomputer 22 senses a voltage variation applied across the sensing resistors in the voltage variation sensing device 21, and judges the laundry material type on the basis of the sensed voltage variation and the current laundry amount in the washing tub.

Figure 7:
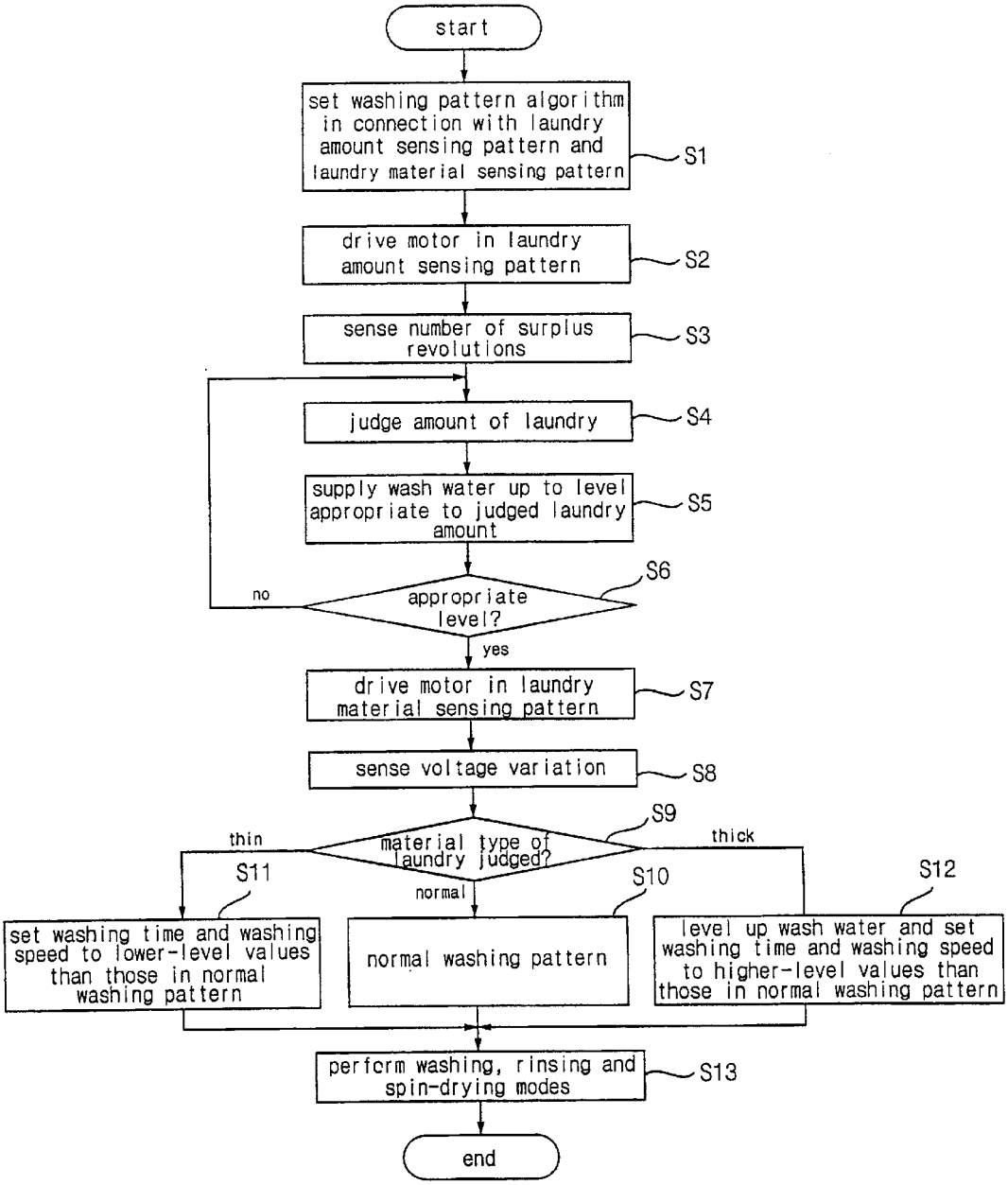
FIG. 7 is a flowchart illustrating the operation of the washing pattern determination apparatus in accordance with the present invention.

The operation of the washing pattern determination apparatus with the above-stated construction in accordance with the present invention will hereinafter be described in detail with reference to a flowchart of FIG. 7.

At the first step S1, the microcomputer 22 is programmed to set a washing pattern algorithm in connection with the laundry amount sensing pattern and laundry material sensing pattern and perform the washing mode of the washing machine according to the set washing pattern algorithm.

At the second step S2, if a user puts laundry into the washing tub and enters a washing start command through a key operation, then the microcomputer 22 generates a motor drive control signal to drive the motor in the laundry amount sensing pattern under the condition that no wash water is supplied to the washing tub.

At the third step S3, after a predetermined period of time elapses, the microcomputer 22 turns off the motor being driven in the laundry amount sensing pattern at the above second step S2, thereby causing the motor to make surplus rotations owing to inertia. At the fourth step S4, the hall sensor 25 attached to the motor 24 generates signals having different surplus rotational periods and times according to different amounts of laundry. Then, the microcomputer 22 processes such output signals from the hall sensor 25 as interrupt signals, senses laundry amount data according to the number of the interrupt signals and judges the amount of laundry from the sensed laundry amount data.

At the fifth step S5, the microcomputer 22 supplies wash water to the washing tub up to a level appropriate to the laundry amount judged at the above fourth step S4. At the sixth step S6, the microcomputer 22 determines whether the wash water has been supplied to the washing tub up to the appropriate level.

If it is determined at the above sixth step S6 that the wash water has not been supplied to the washing tub up to the appropriate level, the microcomputer 22 returns to the above fourth step S4. On the contrary, in the case where it is determined at the above sixth step S6 that the wash water has been supplied to the washing tub up to the appropriate level, the microcomputer 22 drives the motor in the laundry material sensing pattern to judge the material type of the laundry at the seventh step S7.

At the eighth step S8, the microcomputer 22 measures through the voltage variation sensing device 21 a voltage variation occurring when the motor is driven in the laundry material sensing pattern at the above seventh step S7. At the ninth step S9, the microcomputer 22 judges the material type of the laundry put into the washing tub on the basis of the voltage variation measured at the above eighth step S8.

In the case where the laundry material is judged to be normal at the above ninth step S9, the microcomputer 22 sets a normal washing pattern including a normal washing time, normal washing speed and normal washing power at the tenth step S10. Alternatively, if it is judged at the above ninth step S9 that the laundry material is thin, the microcomputer 22 sets the washing time and washing speed to lower-level values than those in the normal washing pattern at the eleventh step S11, so as to reduce damage to the laundry and a washing period of time resulting from over-washing.

On the other hand, in the case where the laundry material is judged to be thick at the above ninth step S9, the microcomputer 22 raises the level of the wash water by one step above the normal washing pattern at the twelfth step S12. Further, the microcomputer 22 sets the washing time and washing speed to higher-level values than those in the normal washing pattern. Therefore, the washing mode is performed for a longer washing period of time and at a higher washing speed than the normal washing pattern, thereby increasing the washing power and thus preventing the degree of cleaning from being degraded.

At the thirteenth step S13, the washing mode is performed in the washing pattern based on the laundry material type judged at the above ninth step S9.

Therefore, according to the present invention, an inverter-type washing machine, which is capable of varying the rotation velocity according to washing conditions such as the kind of laundry put into a washing tub, can judge the amount and material type of the laundry, set a washing time, washing speed, and washing power, etc. in accordance with the judged results and perform a washing mode on the basis of the set washing time, washing speed, washing power, etc., thereby preventing the laundry from being damaged and increasing a washing efficiency, as compared with conventional washing machines.

As apparent from the above description, the present invention provides washing pattern determination apparatus and method wherein a microcomputer judges the type of a material of laundry put into a washing tub of a washing machine on the basis of a voltage variation measured through resistors in a voltage variation sensing device when a motor is driven, as well as the amount of the laundry, and then varies a washing pattern including, for example, the level of wash water, a washing time, a washing speed, etc., appropriately to the judged laundry material type. As a result, the laundry can be prevented from being damaged due to over-washing if it is light. For thick laundry, the washing power can be raised, resulting in an increase in the degree of cleaning.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inverter washing machine for determining a washing pattern for a load of laundry, said inverter washing machine comprising:

a motor and a washing tub;

means for setting a washing pattern algorithm in connection with a laundry amount sensing pattern and a laundry material sensing pattern, and performing a washing mode of the washing machine according to the set washing pattern algorithm, wherein said means for setting the washing pattern algorithm includes a microcomputer;

means for generating a motor drive signal to drive the motor in the laundry amount sensing pattern without supplying wash water to the washing tub if the load of laundry is within the washing tub and a washing start command through a key command is initiated;

means for turning off the motor after a predetermined period of time has elapsed to cause the motor to make a plurality of surplus rotations owing to inertia;

means for generating and processing signals indicative of an amount of the load of laundry based on said surplus rotations and determining the amount of the load of laundry, wherein said means for generating signals includes a hall sensor producing output signals serving as interrupt signals;

means for supplying wash water to the washing tub to a predetermined level based on said amount of the load of laundry;

means for driving the motor in the laundry material sensing pattern to judge a material type of the load of laundry if said predetermined level has been supplied;

means for measuring a voltage variation occurring when the motor is driven in the material sensing pattern and determining a material type of said load of laundry on the basis of the measured voltage variation, wherein said means for measuring the voltage variation includes a DC link terminal connected to a switch performing a switching operation to drive said motor and generate a voltage variation sense signal in accordance with the measured voltage variation;

means for setting a washing pattern including a washing time, and a washing speed for the load of laundry based on said material type of said load of laundry; and means for performing a washing mode based on the washing pattern, wherein said means for supplying wash water, means for driving said motor in the laundry material sensing pattern, and means for measuring the voltage variation applied across the DC link terminal connected to the switch performing the switching operation to drive said motor and generating the voltage variation sense signal in accordance with the measured result includes a voltage variation sensing device having a pair of resistors connected in series to said DC link terminal and a sensing point being positioned between the resistors for monitoring voltage variation to generate said voltage variation sense signal.

2. A washing pattern determination method comprising the steps of:

a) driving a motor in a laundry amount sensing pattern if laundry is put into a washing tub of a washing machine and judging the amount of said laundry and the amount of water supply depending on the laundry amount before water is supplied to the washing tub;

b) supplying wash water to said washing tub if said step a) is completed, driving said motor in a laundry material sensing pattern, measuring a voltage variation applied across a DC link terminal connected to a switch performing a switching operation to drive said motor and generating a voltage variation sense signal in accordance with the measured result;

c) judging the type of a material of said laundry in response to said voltage variation sense signal generated at said step b) and producing a washing pattern appropriate to the amount and material type of said laundry within said washing tub; and d) generating a motor drive control signal to drive said motor in said washing pattern produced at said step c), thereby performing an optimum washing mode;

wherein said step of supplying wash water, driving said motor in the laundry material sensing pattern, and measuring the voltage variation applied across the DC link terminal connected to the switch performing the switching operation to drive said motor and generating the voltage variation sense signal in accordance with the measured result includes a voltage variation sensing device having a pair of resistors connected in series to said DC link terminal and a sensing point being positioned between the resistors for monitoring voltage variation to generate said voltage variation sense signal.

3. The method according to claim 2, wherein said step of driving the motor in said laundry amount sensing pattern and judging the amount of said laundry and the amount of water supply depending on the laundry amount includes generating signals from a hall sensor attached to the motor while the motor makes surplus rotations under the effects of inertia and processing said signals from the hall sensor as interrupt signals to judge the amount of laundry.

4. The washing pattern determination method according to claim 2, wherein the washing machine is a direct drive, inverter washing machine.

* * * * *